US008002244B2

(12) United States Patent
Curchod

(10) Patent No.: US 8,002,244 B2
(45) Date of Patent: Aug. 23, 2011

(54) HIGH LOAD BLOCK CONSTRUCTION AND CONNECTION

(76) Inventor: Donald Butler Curchod, Avalon (AU)

( * ) Notice: Subject to any disclaimer, the term of this patent is extended or adjusted under 35 U.S.C. 154(b) by 738 days.

(21) Appl. No.: 11/721,537

(22) PCT Filed: Dec. 13, 2005

(86) PCT No.: PCT/AU2005/001872

§ 371 (c)(1),
(2), (4) Date: Jun. 13, 2007

(87) PCT Pub. No.: WO2006/063387

PCT Pub. Date: Jun. 22, 2006

(65) Prior Publication Data

US 2009/0200530 A1 Aug. 13, 2009

(30) Foreign Application Priority Data

Dec. 13, 2004 (AU) ..... 2004907083
Feb. 16, 2005 (AU) ..... 20059000708

(51) Int. Cl.
*B66D 3/04* (2006.01)

(52) U.S. Cl. ..... 254/390; 254/392; 254/401

(58) Field of Classification Search ..... 254/390, 254/392, 401, 402, 403, 410
See application file for complete search history.

(56) References Cited

U.S. PATENT DOCUMENTS

| | | | | |
|---|---|---|---|---|
| 230,994 | A * | 8/1880 | Bitting | 384/276 |
| 360,050 | A * | 3/1887 | Redmond | 254/412 |
| 1,406,560 | A * | 2/1922 | Houghton | 254/406 |
| 4,458,390 | A * | 7/1984 | Fogelson | 24/182 |
| 6,305,669 | B1 * | 10/2001 | Harken et al. | 254/412 |
| 7,104,093 | B2 * | 9/2006 | Ling et al. | 70/30 |
| 7,594,642 | B2 * | 9/2009 | Curchod | 254/390 |
| 2005/0227833 | A1 * | 10/2005 | Wilkinson | 482/124 |
| 2006/0075794 | A1 * | 4/2006 | Ling et al. | 70/58 |
| 2008/0197331 | A1 * | 8/2008 | Curchod | 254/390 |

FOREIGN PATENT DOCUMENTS

DE 3405759 A1 * 8/1985

* cited by examiner

*Primary Examiner* — Emmanuel M Marcelo
(74) *Attorney, Agent, or Firm* — Galbreath Law Offices, P.C.; John A. Galbreath

(57) ABSTRACT

A high load lightweight block assembly (1) with a reduced mass hollow central shaft (2) through which a continuous or discontinuous rope loop (10) can be passed, which rope loop (10) carries the tensile operating loads within the block (1) thereby minimizing the weight of the assembly.

22 Claims, 13 Drawing Sheets

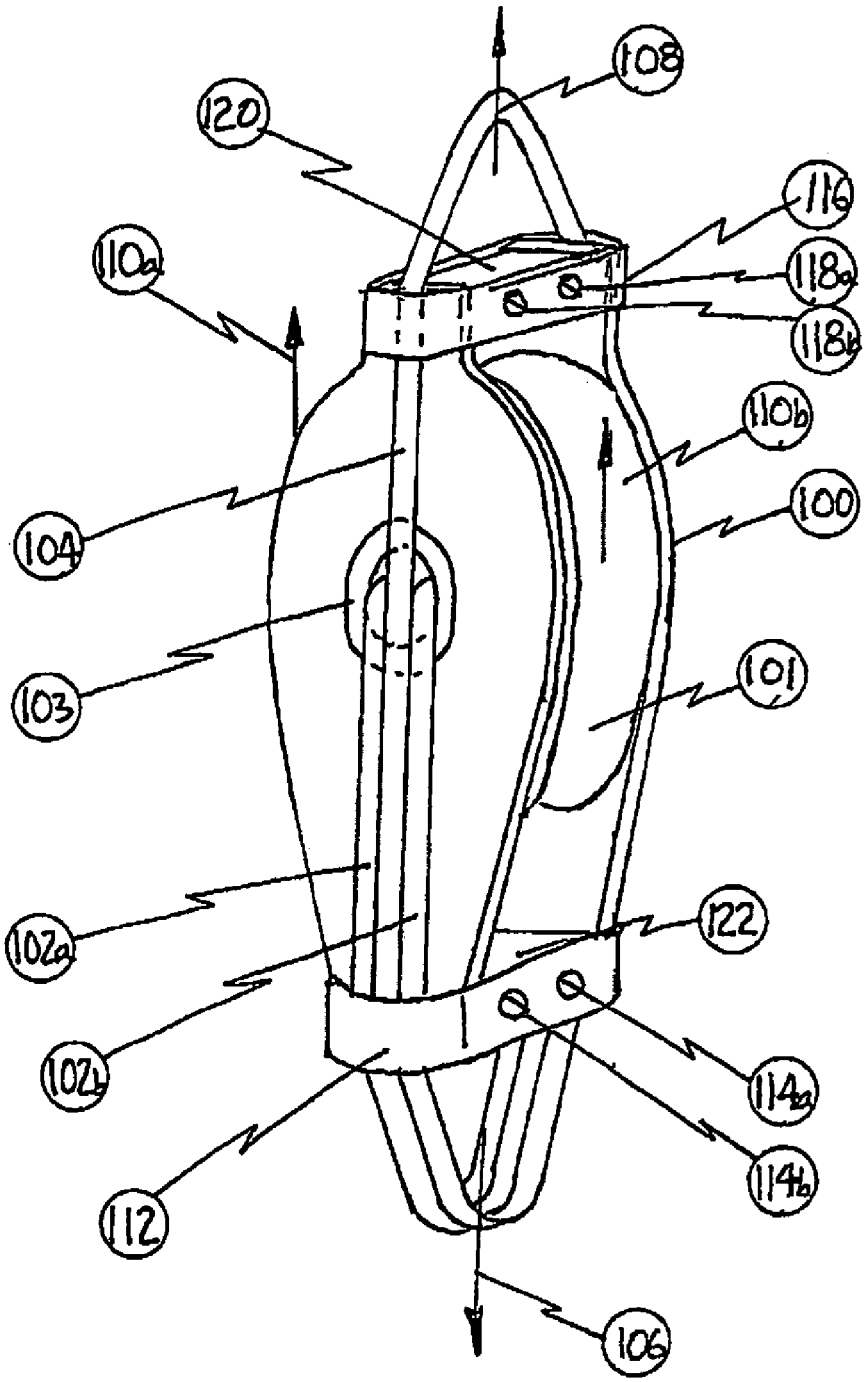
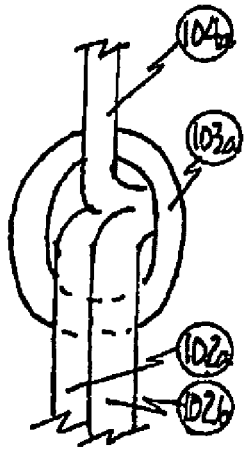
FIG. 5a
FIG. 5.

FIG,10

HIGH LOAD BLOCK CONSTRUCTION AND CONNECTION

FIELD OF INVENTION

This invention relates to a high load lightweight construction and connection system for blocks particularly for use in sail boats by the use of lightweight material design and method.

PRIOR ART

Historically, high load blocks and their connection have been constructed with the stresses within the block and connection being taken by metal including stainless steel, resulting in relatively high weight. Recently more advanced designs have replaced some metal with high strength braid, such as those sold under the trade marks Spectra, Dyneema etc. with a resultant reduction in weight. Since in a yacht, reduction in weight can be directly translated into improved performance there exists a need to further reduce weight in high load yacht fittings such as blocks and their connection.

SUMMARY OF THE INVENTION

The present invention relates to a design utilizing a loop of high strength braid or similar, as those sold under the trade marks Spectra, Dyneema etc and a subsequently reduced metal mass in the hollow shaft of the block to further reduce the weight and hence increase the performance of high load blocks and their construction over the current state of the art.

An object of an embodiment of the invention is to provide a high load lightweight block with a reduced mass hollow central shaft through which a continuous rope loop can be passed, which rope loop carries the tensile operating loads within the block thereby minimising the weight of the assembly. This new technique or invention provides in some embodiments, the minimal amount of metal in the block and the maximum amount of high strength lightweight rope while maintaining alignment within the block, compared to current designs.

Another object of an embodiment of the invention is to provide a high load lightweight block with a reduced mass hollow central shaft through which a continuous rope loop can be passed, which rope loop carries the tensile operating loads within the block thereby minimising the weight of the assembly. This new technique or invention provides the minimal amount of metal in the block and the maximum amount of high strength lightweight rope while maintaining alignment within the block, compared to current designs, which employs a lightweight swivel attachment assembly.

Another object of an embodiment of the invention is to provide a high load lightweight block utilizing a rope loop connection but with a minimal amount of metal in the construction of the block compared to state of the art designs and which has the invention of a loop that can be easily connected and disconnected utilising a new type of joint construction of two eyes and a roughly circular head.

Another object of an embodiment of the invention is to provide a high load lightweight block with a rope loop connection for both the block and a Becket.

Another object of an embodiment of the invention is to provide a high load lightweight block with a rope loop connection for both the block and a Becket and or a spriddle.

Another object of an embodiment of the invention is to provide a high load lightweight block with a rope loop connection where the rope loops are set under load correctly in line.

Yet another object of an embodiment of the invention is to provide a high load lightweight block with a continuous rope loop where the connection to the block uses a secondary loop with a lightweight connection system that can be readily connected and disconnected and where this secondary loop can be used to connect a variety of objects in a lightweight compact manner.

Yet another object of embodiments of the invention is to provide a device to maintain the connection to the loop, central to the block centreline.

Yet another object of embodiments of the invention is to provide a quickly fitted and removed locking wrap to maintain the connection to the block loop, central to the block centreline.

Yet another object of embodiments of the invention is to provide a secondary continuous connection loop to a block which block employing a primary continuous load loop passing through the block centre, which provides a parallel connection with block shaft centre.

Yet another object of embodiments of the invention is to provide a secondary continuous connection loop to a block which block employs a primary continuous load loop passes through the block centre, which can by the addition of new type of bracket allow for angular misalignment of said block between the two connection loops.

In one broad form the invention provides a block including:

- at least one sheave mounted for rotation about a hollow axle;
- at least one length of material extending through the hollow axle and around the sheave,
- whereby a tensile load may be transferred from the at least one length to the sheave via the hollow axle.

At least one length may have two ends. The at least one length may form at least one discontinuous loop. The at least one length may form at least one continuous loop that extends through the axle.

At least two ends may each engage an opposite end of the axle.

At least one of the ends may include a head assembly. At least one head assembly may include an eye and a pin located within the eye. The eye is preferably sized so that when the pin is not located in the eye, the eye may pass through the axle.

At least one head assembly may include a head, said head having a bore through which the first eye may pass through when the pin is not located in the eye. The bore may include a countersunk portion at one end thereof for receiving the first eye with the end of the loop extending through the bore.

The head may comprises a cone with a planar base, said bore extending generally along the axis of the cone from the planar base to the apex of the cone. The countersunk portion may be at the end of the bore remote from the planar base.

The head may be toroidal.

At least two of the ends may include a head assembly.

Another of the ends may include a second eye, said second eye and a head assembly adapted to engage each other. The second eye and the head assembly may be located at opposite ends of the same length of material. The second eye and the head assembly may be located on different lengths of material.

The block may include at least one side plate extending on either side of the sheave and spacing the at least one length from the sheave. The at least one length may be secured to at least one side plate. At least one strap may also extends around the side plates and the at least one length.

The block may also include a spacer assembly extending between said side plates. The at least one strap may be secured to the spacer assembly.

The block may also include a swivel assembly supported by said at least one loop. The swivel assembly may also include:

a support member supported by said at least one loop, and a keeper, rotatably mounted on the support member, said keeper for attachment to a tensile load.

The keeper preferably rotates about an axis substantially perpendicular to the axis of rotation of the sheave.

The support member may be supported by at least two sets of sections of loop material, said sets being spaced apart and generally parallel to each other.

Each of the at least two sets may extend through a respective bore in the support member, said bores being spaced apart and generally parallel.

The at least two sets may extend under the support member.

The at least two sets may extend generally parallel to the axle. The at least two sets may extend generally perpendicular to the axle.

The keeper may have a bore adapted to receive a loop.

As used throughout the description and the claims a continuous loop includes a length material in which the ends have been spliced together or permanently affixed together. A discontinuous loop includes a length material in which the ends can be selectively and repeatedly connected and disconnected Unless the context clearly requires otherwise, throughout the description and the claims the words 'comprise', 'comprising', and the like are to be construed in an inclusive sense as opposed to an exclusive or exhaustive sense; that is to say, in the sense of "including, but not limited to".

BRIEF DESCRIPTION OF DRAWINGS

FIG. 5 shows an isometric view of the high load lightweight block of FIG. 1, with an elongate continuous double rope loop connection together with a separate loop or loops for a Becket.

FIG. 5*a* shows an isometric view of the central portion of the high load lightweight block of FIG. 5, with an elongate continuous double rope loop connection together with an alternative separate loop for a Becket.

FIG. 10 is an alternative part section elevation of FIG. 3 with an alternative secondary connection loop.

DETAILED DESCRIPTION OF THE PREFERRED EMBODIMENTS OF THE INVENTION

Figure 1:
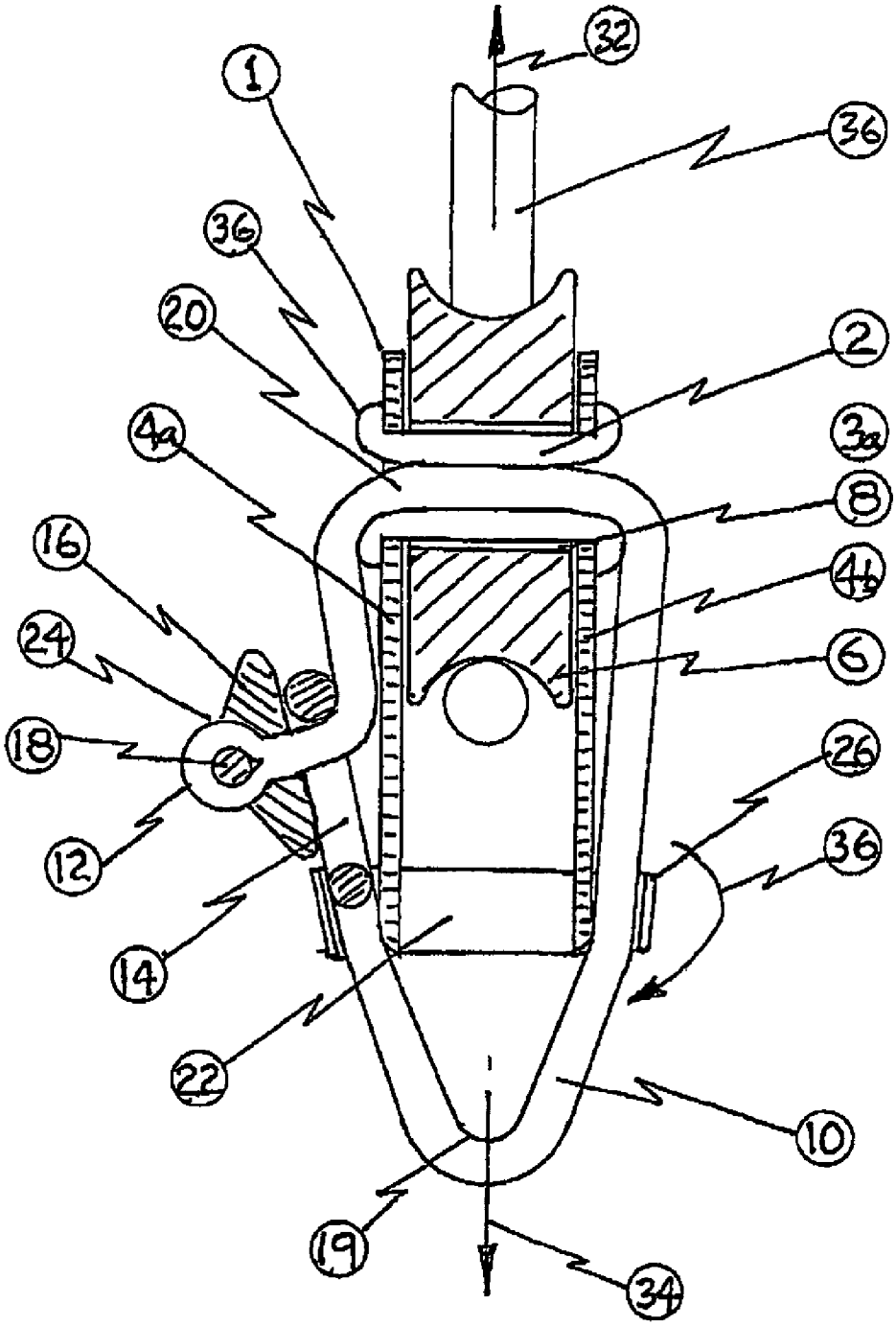
FIG. 1 shows a cross section of a high load lightweight block with a hollow central shaft and an elongate rope loop connection which can be readily connected and disconnected.

FIG. 1 shows a typical block 1 according to the present invention where hollow shaft 2 with bosses 3*a* and 3*b* has side plates 4*a* and 4*b* and sheave 6 with bearing 8.

Not shown is thread of one of side bosses 3*a* or 3*b* of shaft 2, required in order to assemble block.

Loop 10, with eyes 12 and 14 (shown sectioned) passes through hollow shaft 2 at 20 and around block 1 past compression member 22 and is connected to itself at head 24 to form an easily connected and disconnected connection loop 10.

Loop 10 is retained in position on block 1, by strap 26 which wraps around block 1 shown by arrow 36.

Load is applied via rope 36 around sheave 6, at 32 on one end and at 34 on the other end such that tensile forces when load is applied to block 1 are taken by loop 10 via centre of sheave 6.

If desired, two or more lengths of material, each having a head and an eye may be daisy chained together to form a single loop.

Figure 2:
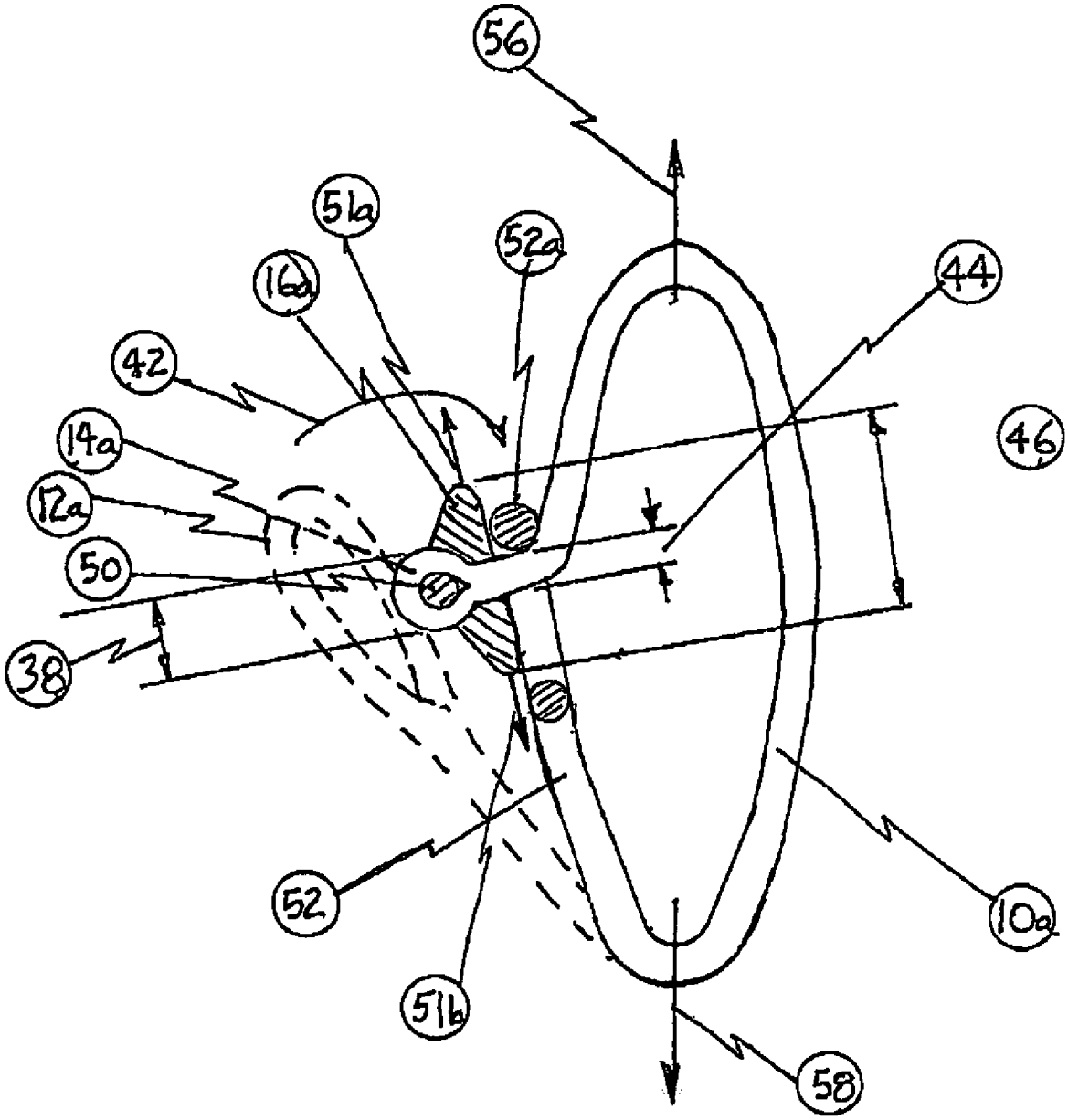
FIG. 2 shows a cross section of a high load lightweight elongate rope loop with a connection which can be readily connected and disconnected.
Figure 3:
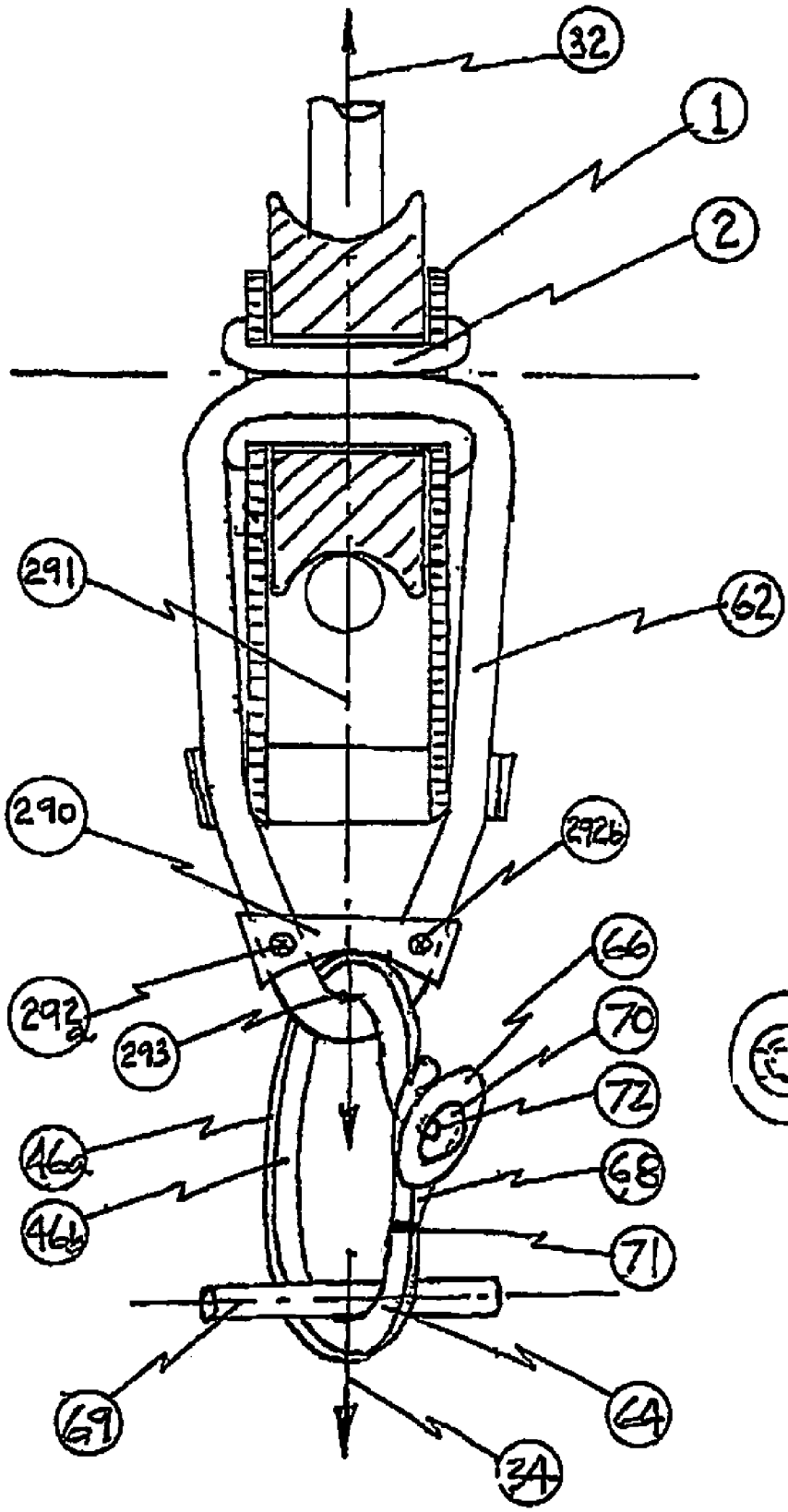
FIG. 3 shows a cross section of the high load lightweight block as in FIG. 1, with an elongate continuous rope loop connection together with an isometric view of a secondary rope loop similar to the loop of FIGS. 1 and 2 with a high load lightweight connection which can be connected and disconnected readily.

FIG. 2 shows the loop of FIG. 1 as a separate identity with the ability of being used to connect not only block 1 of FIG. 3, but a wide variety of other objects. With regard to FIG. 2, shows a loop 10*a* similar to loop 10 of FIG. 1 and loop 10*b* similar to of FIG. 3.

Rope loop 10*a* with formed eyes 12*a* and 14*a* (typically formed by splicing) has a toroidal head 16*a*. Toroidal head 16*a* has centre hole 44, outer diameter 46 and countersunk bore 38. Loop 10*a* is a snug fit in centre hole 44. Eye 14*a* has a cross pin 50 of such a diameter that eye 14*a* and pin 50 form a head which fits in counter-sunk bore 38 and is substantially larger than centre hole 44.

Eye 12*a*, shown by dotted lines of loop 10*a*, fits over toroid 16*a* and outer diameter 46 shown by arrow 42 into position 52*a* and 52*b* so that loop 10*a* forms a continuous closed loop which is readily connected and disconnected to form a tensile connection between opposing loads applied at 56 and 58 respectively.

Such a connection, when loaded, stresses toroid 16*a* radially, shown at 51*a* and 51*b*, and produces a significantly smaller and lighter connection head 16*a* than current "dog bone" type connections.

Hole 44 has a radius at each end. When loaded, head 16*a* is jammed into and restrained by hole 44 and this jamming action places pin 50 in compression.

This jamming action in hole 44 allows eye 14*a*, if spliced to have a much shorter tail to hold high loads at 56 and 58 than would otherwise be possible.

Spliced eye 12*a* is only slightly larger than outer diameter 46 of toroidal head 16*a* and hence, when passed over head 16*a* to position 52*a* and 52*b*, and load is applied at 56 and 58, eye 12*a* will remain locked in position 52*a* to form a highly reliable easily connectable high load connection.

FIG. 3 shows block 1 which is similar to that of FIG. 1 but has a loop 62 which is continuous. Connection of block is made by secondary loop 64, similar in construction to loop 10 of FIG. 1 and 10*a* of FIG. 2. This loop 64 can be readily attached and detached via toroidal head 66 and eye 68, with eye 70. Eye 68 is formed by a tie shown at 71.

To aid in ensuring that loads 32 and 34 via loops 46 and 62 always pass through or close to the centre line of the block 291, a locating bracket 290 is preferably provided to retain block connection point 293 centrally. The bracket 290 is preferably secured with locating screws 292*a* and 292*b*, which screw into the loop 62. Other fastening methods may be used. Other methods of retaining the loop 46 generally centrally may also be used. The bracket 290 is not essential and may be omitted.

Pin 72 restrains head 66, forming a connection similar to that of FIG. 2 except that FIG. 3 shows a double loop 46*a* and 46*b*. Using a double loop with single head 66 allows for a smaller joint than with a single loop. This also allows block to be connected to shaft 69 parallel to shaft of 2 of block 1, as shown, or to shaft 69 such that shaft 2 of block 1, is perpendicular to shaft 69. The load direction is shown by arrows 32 and 34.

Figure 3A:
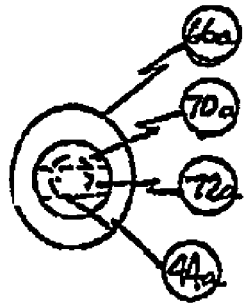
FIG. 3*a* shows and end elevation of head of a secondary connectable loop of FIG. 3.

FIG. 3*a* shows a view of head 66 of FIG. 3.

Outer diameter 66*a*, which is roughly circular, has counter bore and shows head 70*a*, centre hole 44*a* and pin 72 of FIG. 3, at 72*a*.

Figure 3B:
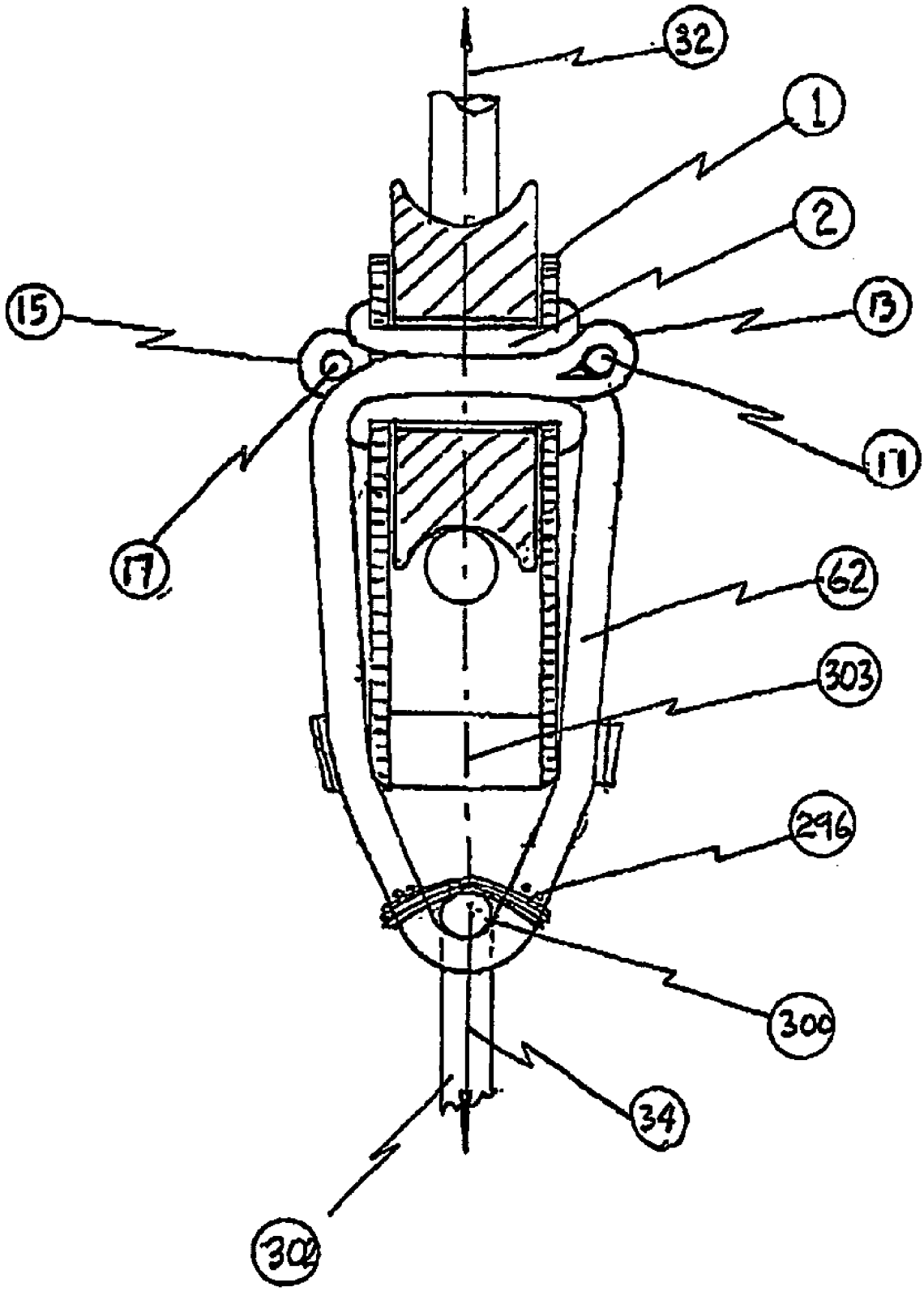
FIG. 3*b* shows a block similar to that of FIG. 3, but with a non continuous loop.

FIG. 3*b* shows block assembly of FIG. 3, in which loop 62 is not continuous but has spliced eye ends 15 and 16 respectively on each side of block 1. Pins 11 and 17 secure spliced ends 13 and 15 so that loop 62 will hold when loaded at 32 and 34.

In order that loads 32 and 34, via loops 62 and 302, preferably pass through or close to the centre line of the block 291 a locating whipping 296 is provided to retain block connection point 300 centrally. It will be appreciated that the bracket of FIG. 3 may be used instead. Similarly, the whipping of FIG. 3*b* may be used with the embodiment of FIG. 3. The whipping 296 is not essential and may be omitted.

If desired, the single loop may be formed of two or more lengths of material that are joined together using a head and eye arrangement as in FIGS. 1 and 2 with the free ends of the chain of lengths engaging in opposite ends of the hollow axle.

Figure 4:
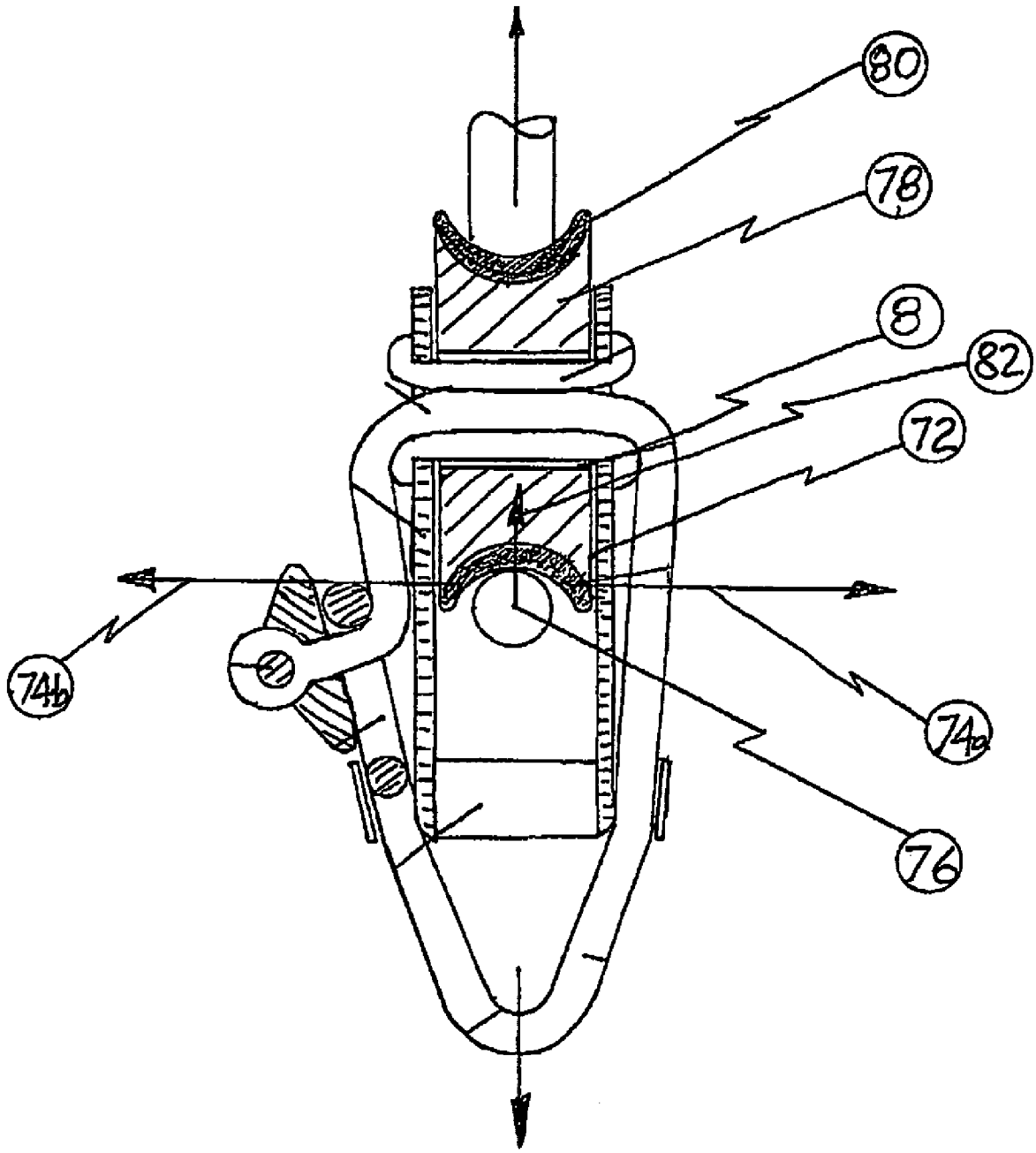
FIG. 4 shows a cross section of a high load lightweight block as in FIG. 1 with a high load lightweight sheave construction.

Regarding FIG. 4, the block arrangement, which is similar to that of FIG. 1, has sheave 72 with bearing 8. For high loads, such a sheave is currently typically made of metal so as to contain spreading forces shown at 74*a* and 74*b* generated by loaded rope section 76.

Sheave 72 of FIG. 4 is constructed with outer layer 80 made of lightweight plastic reinforced by fibers such as carbon fiber running predominantly in direction 74*a* and 74*b* (note, layer 80 may be either cored or uncored as shown) so as to restrain spreading forces in the direction of arrows 74*a* and 74*b*.

The centre 78 of sheave 72, being under mostly compression forces 82, can be made with numerous filled or unfilled lightweight plastic materials.

In this way a lightweight plastic sheave can be constructed to withstand similar loads to that of a heavier metal sheave.

FIG. 5 shows the outline of a block 100 according to the present invention and is similar to the blocks of FIG. 3 but with dual loops. The primary loop is doubled at 102*a* and 102*b* and connects the central shaft 103 to connection point 106. The primary loops 102*a* and 102*b* are held in place by strap 112 and screws 114*a* and 114*b* and piece 122 opposes the compression forces when block 100 is loaded.

FIG. 5 also shows a second single loop 104 (which could also be a double loop) for a Becket connection. Becket loop 104 connects point 108 to opposite end 106. Secondary Becket loop 104 is retained by strap 116 and screws 118*a* and 118*b* and block 120 resists compression of loop 104 when loaded.

This connection of the Becket loop 104 increases the load of the block by 50%, compared to traditional Beckets and compared to FIG. 5*a*, an alternative construction, which shows the central shaft 103 portion of FIG. 5 but has Becket loop 104*a* passing through the central shaft 103*a* together with primary loop or loops 102*a* and 102*b* and this FIG. 5*a* configuration does not increase the load bearing capacity of the block assembly.

In FIG. 5, loads are shown for sheave 101 at 110*a* and 110*b*, and at Becket 108 opposed by forces at connection point 106.

Figure 5B:
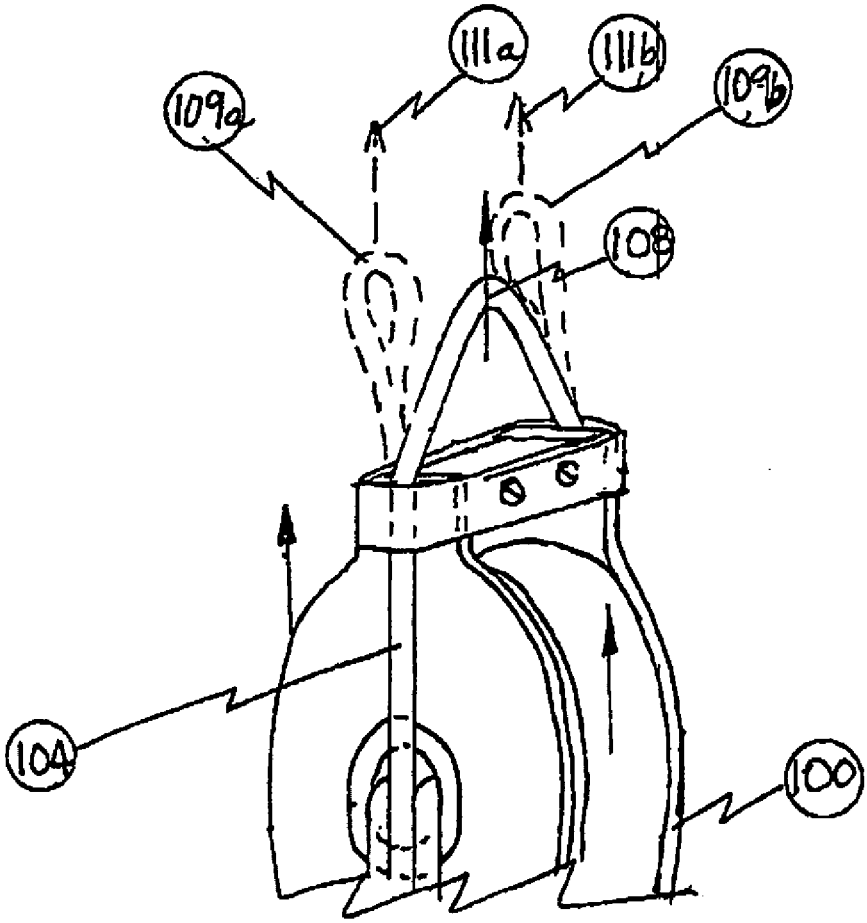
FIG. 5*b* shows a partial isometric view of the high load lightweight block of FIG. 1, with an elongate continuous double rope loop connection together with a separate loop for a Becket, which loop does not pass through the centre of the block.

FIG. 5*b* shows an alternative Becket connection of block 100 of FIG. 5 where Becket loop 108 is not continuous, but is formed from two loops 109*a* and 109*b* taking Becket loads 111*a* and 111*b*.

Figure 5C:
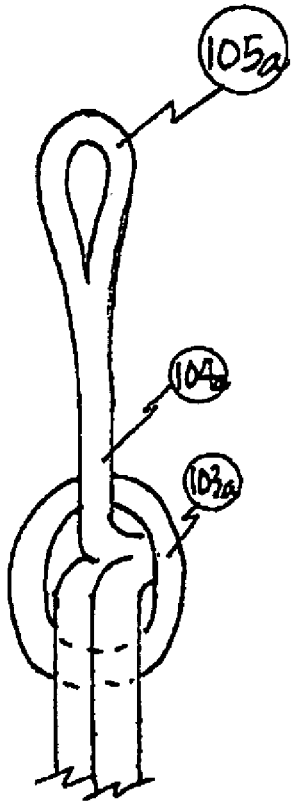
FIG. 5*c* shows a partial isometric view of the central section of the high load lightweight block of FIG. 1, with an elongate continuous double rope loop connection together with a separate loop for a Becket, which loop passes through the centre.

FIG. 5*c* shows central portion 103*a* of block 100 of FIG. 5, having Becket loop 104 which is not continuous but has two end loops for the Becket connection, one of which is shown at 105*a*.

Figure 5D:
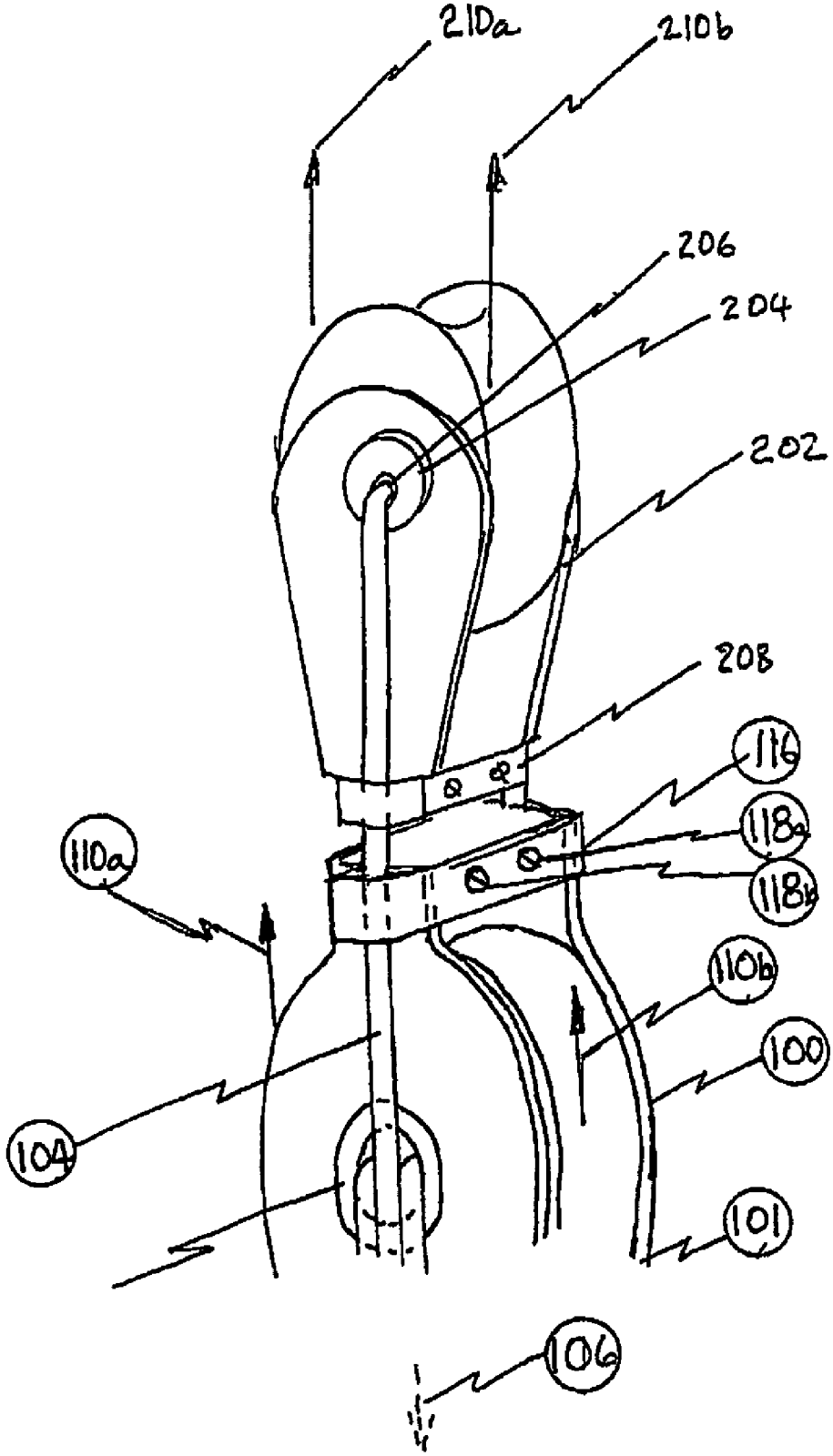
FIG. 5*d* shows an isometric view of portion of the high load lightweight block of FIG. 1, with an elongate continuous double rope loop connection together with a separate loop for a Becket.

FIG. 5*d* shows a portion of block 100 of FIG. 5 where loop 104 passes through second spriddle block 202 via centre of hollow shaft 204 at 206 and restrained by strap 208 so that assembly forms a spriddle block 202 having rope loads 210*a* and 210*b* added to rope loads 110*a* and 110*b*, all terminating at point 105 (not shown) and restrained by opposite load shown dotted at 106.

It is important in high load blocks that the load as shown in FIG. 1, by arrow 32 of rope 36, be perfectly in line with respect to block 1 and connection point 34, to avoid cocking and damage. Since rope loop 10 is pliable when first fitted it can easily become misaligned when first loaded.

This problem can be avoided by the method of loading block 1 of FIG. 1 at load point 34 to at least 10% of its rated value making sure point 34 when so loaded, is exactly aligned with block sheave 6 having direction 32.

In this way, correct point 34 becomes stiff and set in loop 10, so that that when connected in the field, a mating part will automatically align itself in the pre formed radius 19 of 34 so that block does not cock under load.

Figure 6:
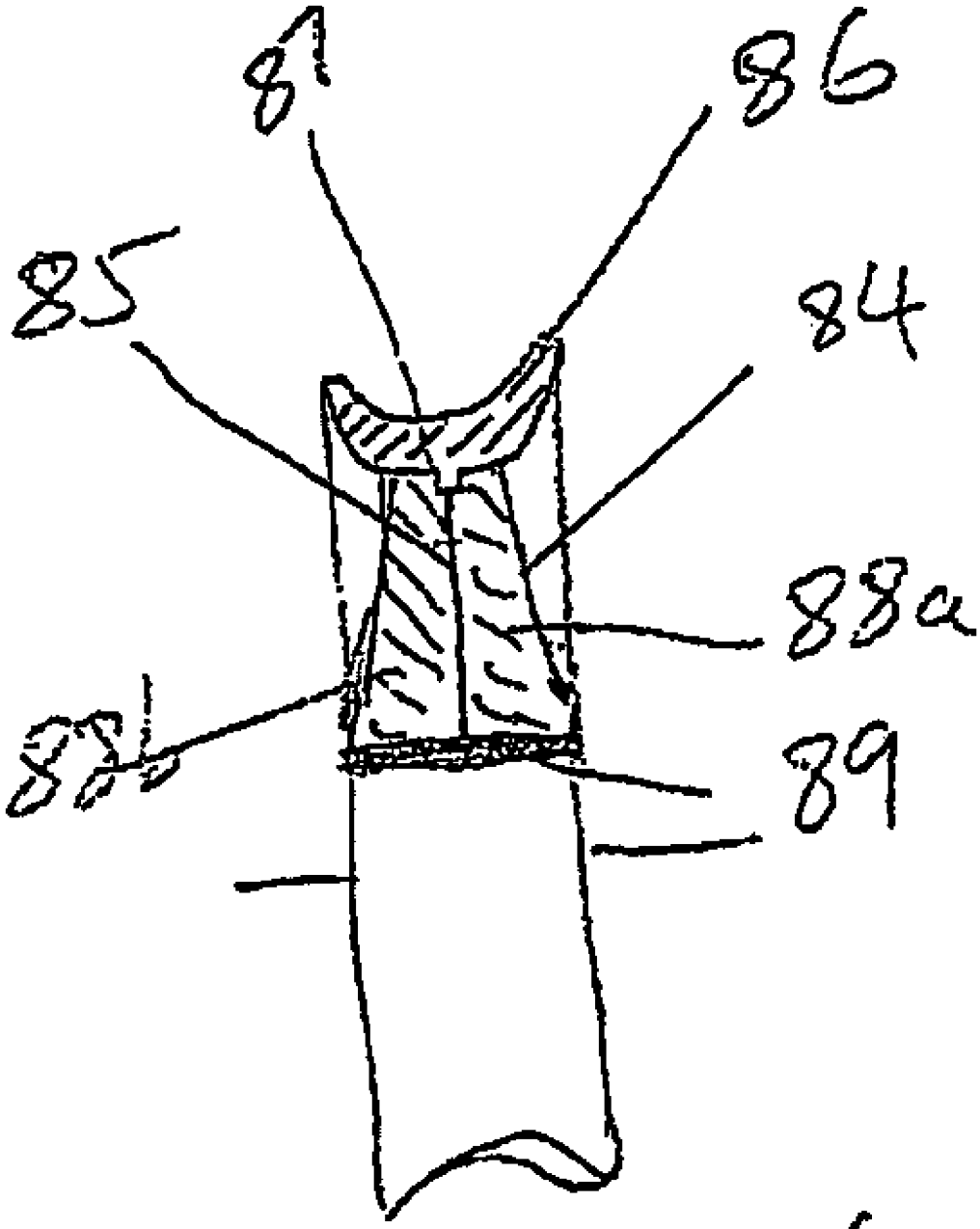
FIG. 6 shows a part section elevation of an alternative high load lightweight sheave construction.

FIG. 6 shows sheave 84 similar to that of 72 of FIG. 4, with bearing 8 but where outer portion 86 is made with reinforced plastic or in lightweight metal It should be noted with regard to FIG. 6, that tab 87 formed in outer portion 86 maintains alignment of outer portion 86 in body of sheave 88*a* and 88*b* while central portion 88*a* and 88*b* is made of plastic material glued together at 85.

Figure 7:
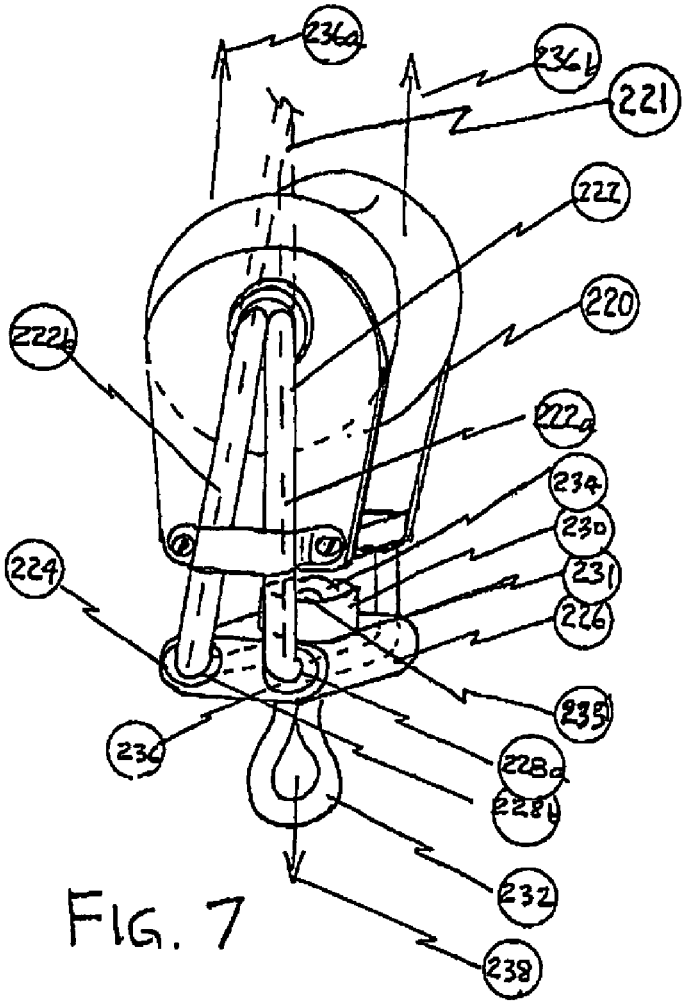
FIG. 7 shows an isometric view of the high load lightweight block as in FIG. 1, with an elongate continuous rope loop which continuous loop is connected to a swivel assembly having a secondary connection loop.

FIG. 7 shows a block 220 similar to blocks 1 of FIG. 1 and 100 of FIG. 5 but has loop 222 passing through a swivel assembly 224.

Swivel assembly 224 comprises a one piece block 226 (or alternatively multiple pieces).

Block 226 has two holes 228*a* and 228*b* with radius entry points 236 through which double loop 222*a* and 222*b* respectively pass. Block 226 has a central hole through which tube 230, having shoulder portion 231, passes.

Loop 232 fits through centre of tube 230 and is restrained by pin 235 so as to form connection loop 232 such that when load at block shown by 236*a* and 236*b* and opposing load 238 is applied, block 220 and loads 236*a* and 236*b* is able to rotate about tube 230 and opposing load at 234.

Shown at 221 in dotted outline is the possibility of the addition of a spriddle, or Becket (or both) to block 220.

Figure 7A:
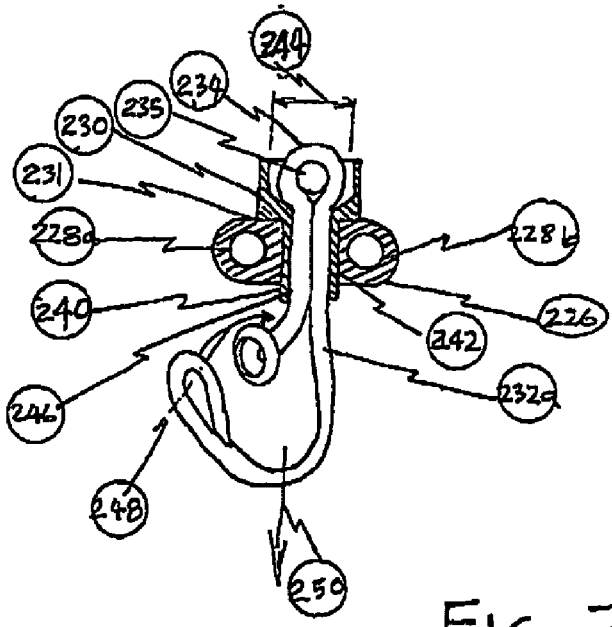
FIG. 7*a* shows a cross section of the high load lightweight block swivel assembly and secondary loop of FIG. 7 in which second loop is more easily dis-connectable.

FIG. 7*a* shows a cross section of swivel assembly 224 of FIG. 7, but where loop 232*a* has a quick connection similar to that of FIGS. 1 and 2. Block 228 has holes 228*a* and 228*b* and central hole 242 through which reduced diameter portion 240 passes. The shoulder 231 of tube 230 bears on the upper surface of the block 226 so that tube 230 and loops 232 or 232*a* are able to rotate with respect to block 226 and hence block 220 of FIG. 7.

The inside diameter 246 of through tube 230 is such that loop 232*a* is a tight fit, Loop 232*a* has head 234 forming a loop with pin 235 such that head 234 sits in socket 244, which is substantially larger than the diameter of hole 246 of portion 240.

When loop 232, closed at 248, is loaded at 250, loop 232*a* is restrained by block 226 by the head 234 being substantially larger than the hole 246. Load is transferred to shoulder 231 and hence to loops 222*a* and 222*b* and finally to sheave wraps 232*a* and 232*b* of FIG. 7 to form a lightweight high load block which can be aligned in any direction.

Figure 8:
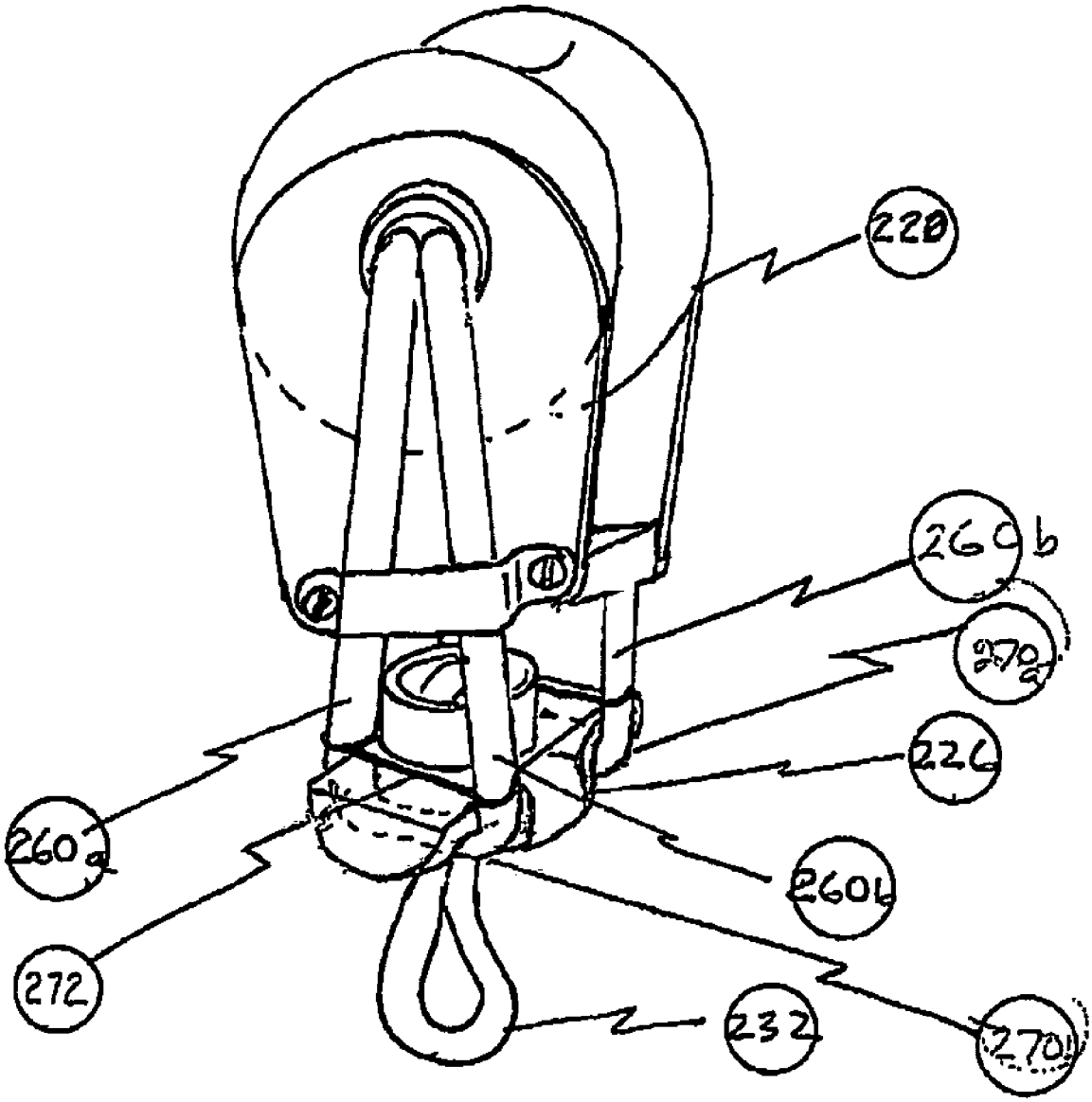
FIG. 8 shows an isometric view of an alternative to the block 220 of FIG. 7.

FIG. 8 shows an alternative to the block 220 of FIG. 7, with swivel assembly 280 having loop legs 260*a* and 260*b* at 90 degrees to that of legs 222*a* and 222*b* of FIG. 7. The swivel body 282 incorporates a continuous loop 232 and tube 230 as in FIGS. 7 and 7*a*. However, the swivel body 282 does not include bores through which the loops 260*a* & 260*b* pass. Instead loops 260*a* & 260*b* pass underneath the swivel body 282 at 270*a* and 270*b*. Thus there is no material at 270*a* and 270*b* under loop 260*a* and 260*b*. Ties 272*a* & 272*b* keep loops 260*a* and 260*b* in contact with swivel body 226.

Figure 9:
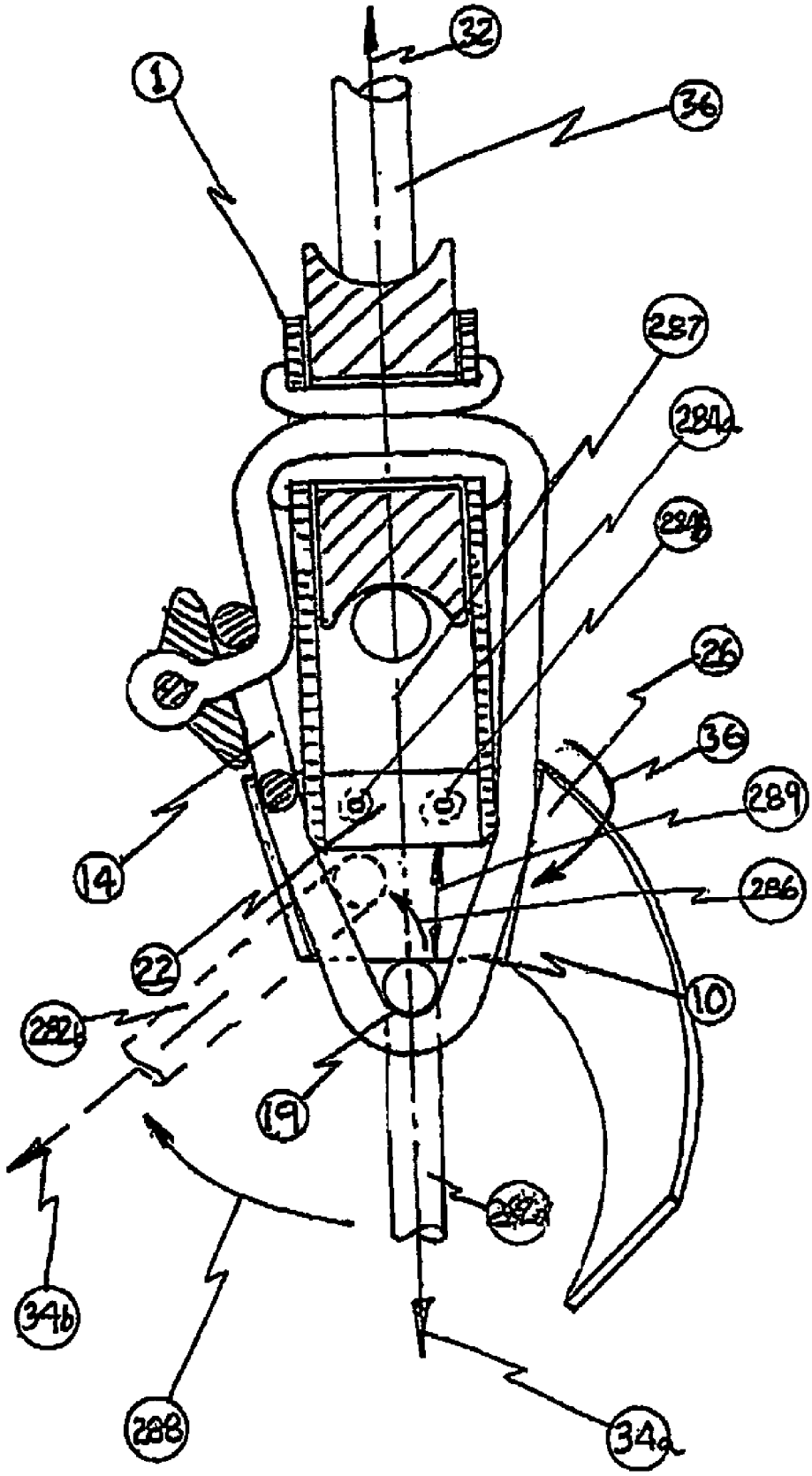
FIG. 9 is an alternative part section of FIG. 1 with a modified wrap.

FIG. 9 shows a variation of the FIG. 1 embodiment designed to maintain loadings on or near the centreline of the block.

It is possible when the soft loop block 1 of FIG. 9 is unloaded, for connection 282*a* to move from central connection point 19 to an off centre point shown by arrow 286, at dotted position 282*b*. Thus, when block is re loaded at 32, load line 282*a*, which has moved from central point 19 to off centre point 282*b*, causes undue side load to be applied to block 1.

In order to avoid this potentially damaging situation a wrap 26 is provided which bridges the gap 289 so that connection 282*a* is unable to move from central position 19.

The wrap 26 is preferably connected to block spacer 22 via screws 284*a* and 284*b* and is provided with hook and loop fastener material at its ends, such as that sold under the brand name of Velcro, so that the wrap 26 is easily and quickly done up and undone. It will be appreciated that the wrap 26 may be used with the embodiments of FIGS. 3 and 3*a*. Similarly, the bracket 290 of FIG. 3 and the wrapping 296 of FIG. 3*b* may be used with the FIG. 9 embodiment.

Figure 10A:
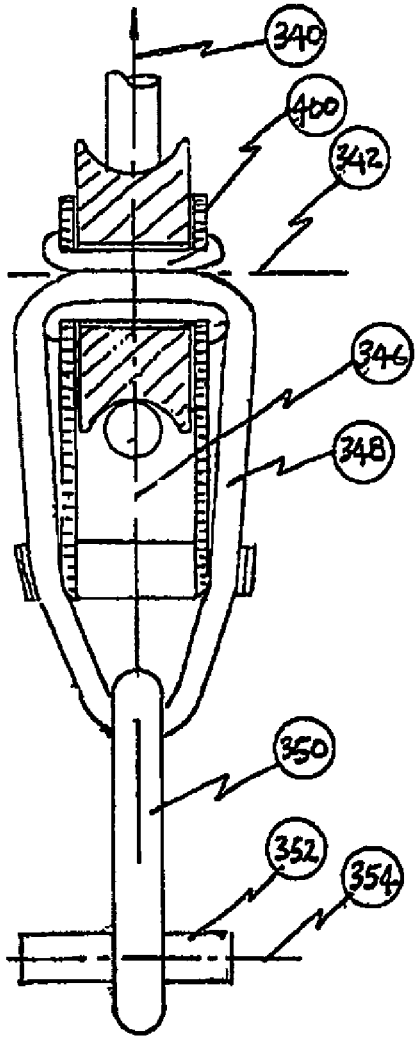
FIG. 10*a* is an alternative part section elevation of FIG. 3 with an alternative secondary connection loop swivel
Figure 10A:
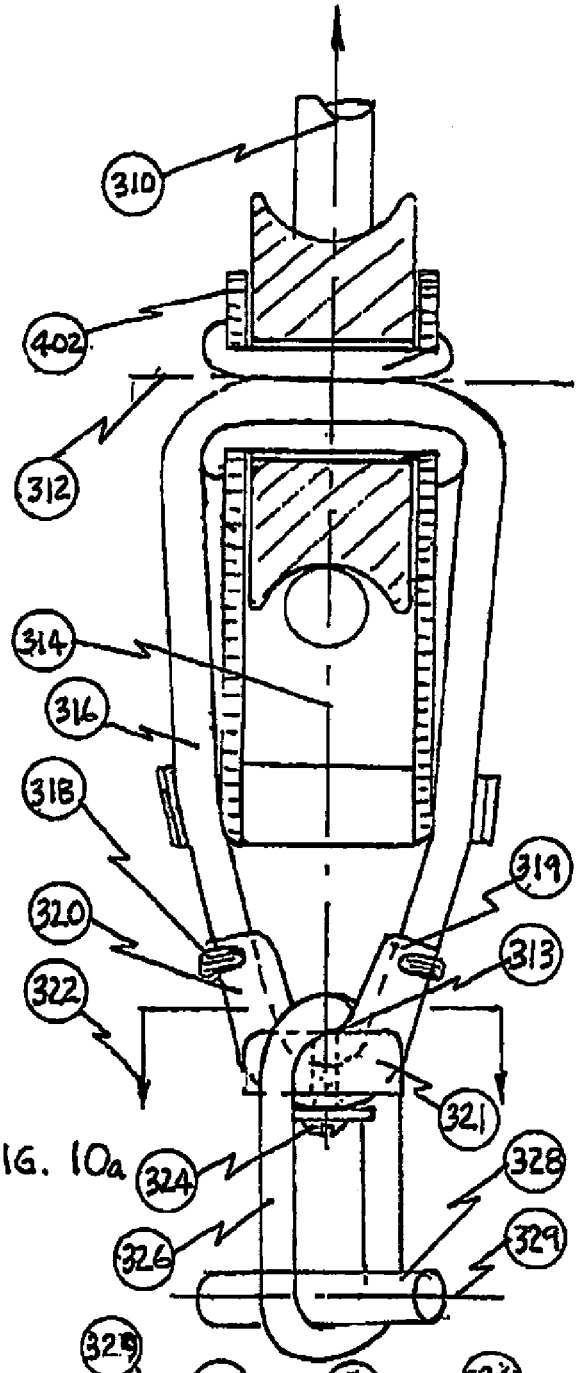

FIG. 10 shows a block 400, which is identical to block 1 of FIG. 3, but which has a continuous secondary loop 350. The block 400 can be attached to a boat via shaft 352 so that, when loaded, axis of shaft 342 of block 400 is parallel to the centreline 354 of shaft 352.

Figure 10B:
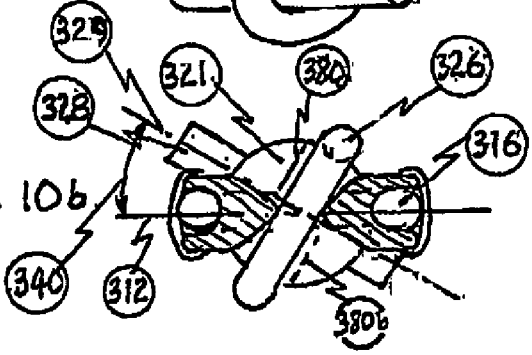
FIG. 10*b* is a part cross section of block of 10*a*

FIGS. 10*a* and 10*b* show a block 402 having a continuous loop 316. An additional bracket 320 is located between loop 316 and secondary connection loop 326. The block 402 may be connected to a boat via shaft 328 so that, when loaded, axis 312 of block 402 may be maintained at an angle to boat connection axis 329.

Bracket 320 has U-shaped side legs 319 and integral base 321. The loop 316 passes within U shaped legs 319 (shown at 339 of FIG. 10*b*) and under base 321. The loop 316 is held in the centreline 314 of block 402 by whipping 318 and screw and washer 324 centrally in base 321.

The base 321 has a circular outer portion so that the secondary loop 326 passing through the base 321 is located centrally in bracket 320 at 313 and can rotate about a generally vertical axis.

FIG. 10*b* is a cross section of block 402 at 322 showing a plan view of the primary loop 316 passing under bracket 321. Secondary loop 326 passes over circular base 321 and around shaft 328. Secondary loop 326 is held centrally with respect to block 402 centreline 314 in bracket 320 but is able to rotate through angle 340 with respect to block axis 312.

Thus continuous integrity and safety of connection loops 316 and 326 can be maintained between block 402 and boat shaft 328 while allowing angular rotation 340 between block 402 and boat connection shaft 328.

It should be noted that it with respect to FIG. 10*b* it is possible to provide guides or stops shown dotted at 380*a* and 380*b* to maintain a specific angle between axis 312 of block 402 and axis 329 of shaft 328.

It should be noted that the concepts disclosed are not meant to be complete or define a particular model or limit the concepts or application in any way. Various arrangements are shown but any one arrangement may be applied to another without limit.

From the foregoing it should be readily evident that that there has been provided an improved lightweight high load block assembly and connection method.

The claims defining the invention are as follows:

1. A block including:

at least one sheave mounted for rotation about a hollow axle;

at least one length of flexible material forming at least one discontinuous loop extending through the hollow axle and around the sheave, whereby a tensile load may be transferred from the at least one length to the sheave via the hollow axle, and wherein the at least one discontinuous loop has first and second ends and wherein at least the first end includes a head assembly, said head assembly including an eye and a pin located within the eye.

2. The block of claim 1 wherein at least two ends engages an opposite end of the axle.

3. The block of claim 1 wherein, when the pin is not located in the eye, the eye may pass through the axle.

4. The block of claim 1 wherein the head assembly at the first end includes a head, said head having a bore through which the eye may pass through when the pin is not located in the eye.

5. The block of claim 4 wherein the bore includes a countersunk portion at one end thereof for receiving the eye with the first end of the loop extending through the bore.

6. The block of claim 4 wherein the head comprises a cone with a planar base, said bore extending generally along the axis of the cone from the planar base to the apex of the cone.

7. The block of claim 6 wherein the countersunk portion is at the end of the bore remote from the planar base.

8. The block of claim 4 wherein the head is toroidal.

9. The block of claim 1 wherein said second end includes a second eye, said second eye adapted to engage the head assembly at the first end.

10. The block of claim 9 wherein the second eye and the head assembly are located at opposite ends of the same length of material.

11. A connector including:

at least one length of flexible material having first and second ends adapted to connect to each other to form a closed loop, a head having a bore mounted on the flexible material adjacent a first end of the flexible material with the flexible material passing through the bore of the head, the flexible material having a first eye at the first end with the head located between the first eye at the first end and the second end; and a compression pin located within the first eye, whereby passage of the first end through the bore of the head is prevented.

12. The connector of claim 11 wherein the head is free to move along the flexible material away from the first eye toward the second end.

13. The connector of claim 11 wherein the second end includes a second eye, said second eye sized to pass over and engage said head.

14. The connector of claim 11 wherein said head is toroidal.

15. The combination of:

a block including at least one sheave mounted for rotation about an axle, and a connector including:

at least one length of flexible material having first and second ends adapted to connect to each other to form a closed loop, a head having a first bore mounted on the flexible material adjacent a first end of the flexible material with the flexible material passing through the first bore of the head, the first end of the flexible material configured to prevent passage of the first end through the first bore of the head, wherein the connector is connected to the block, whereby load applied to the connector is transferred to the block.

16. The combination of claim 15 wherein a second bore extends axially through the axle and the connector passes through the second bore forms a closed loop about the sheave.

17. The combination of claim 16 wherein and the first and second ends engage each other to form a closed loop about the sheave.

18. The combination of claim 15 wherein a second bore extends axially through the axle and including at least one second closed loop extending about the sheave and passing through the second bore.

19. The combination of claim 18 wherein the connector forms a closed loop about the at least one second closed loop.

20. The combination of claim 15 wherein the block includes a swivel assembly and wherein the swivel assembly includes:

a support member and a keeper, rotatably mounted on the support member, said keeper for attachment to a tensile load and wherein the keeper has a third bore, at least part of said connector passing through said third bore.

21. The combination of claim 15 including a Becket extending around the sheave from opposed sides of the block above and below the axle, whereby loads applied to one end of the Becket can be transferred to the other without passing through the block.

22. The block of claim 21 characterised in that the Becket is a continuous or discontinuous loop.

* * * * *